US005367742A

United States Patent [19]

Bindman

[11] Patent Number: 5,367,742

[45] Date of Patent: Nov. 29, 1994

[54] CLICK-LOCK RING FOR HANGING SHOWER CURTAINS

[75] Inventor: Stanley Bindman, Roslyn Heights, N.Y.

[73] Assignee: Creative Bath Products, Inc., Central Islip, N.Y.

[21] Appl. No.: 85,016

[22] Filed: Jun. 29, 1993

[51] Int. Cl.[5] ..... E05D 15/00

[52] U.S. Cl. ..... 16/87.2

[58] Field of Search ..... 16/87.2, 87.4, 87.6, 16/87.8, 93 D, 94 D, 95 D, 96 D; 24/625, 716, 598.2

[56] References Cited

U.S. PATENT DOCUMENTS

| | | | |
|---|---|---|---|
| 1,034,630 | 8/1912 | Laun | 16/87.2 |
| 1,209,083 | 12/1916 | Wagner, Jr. | 24/598.2 |
| 2,320,308 | 5/1943 | Silverman | 16/87.2 |
| 2,711,555 | 6/1955 | Hanson | 16/87.2 |
| 4,010,503 | 3/1977 | Denton | 16/87.2 |
| 4,308,637 | 1/1982 | Kucera | 16/93 D |

FOREIGN PATENT DOCUMENTS

| | | | |
|---|---|---|---|
| 60891 | 8/1913 | Austria | 16/87.2 |
| 2022705 | 11/1970 | Germany | 16/87.2 |

*Primary Examiner*—P. Austin Bradley
*Assistant Examiner*—Chuck Y. Mah
*Attorney, Agent, or Firm*—Schweitzer Cornman & Gross

[57] ABSTRACT

Described herein is a click-lock ring for use in hanging shower curtains designed in the form of a split ring wherein one end of the split ring contains a stepped anchoring recess formed from two cooperating lateral openings for receiving a locking head formed at the other end of the split ring. The ring is produced by injection molding a flexible plastic material in a cam-free mold.

2 Claims, 2 Drawing Sheets

FIG. 4
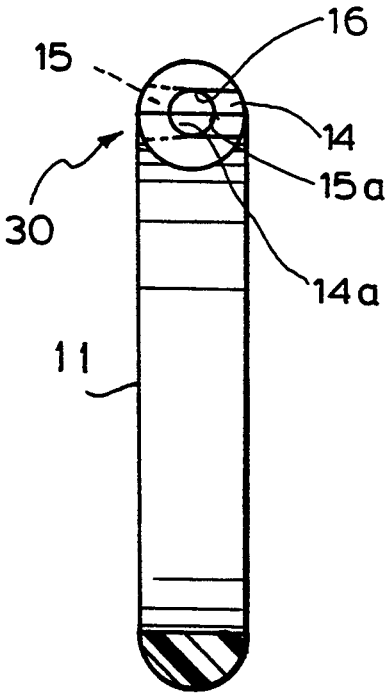
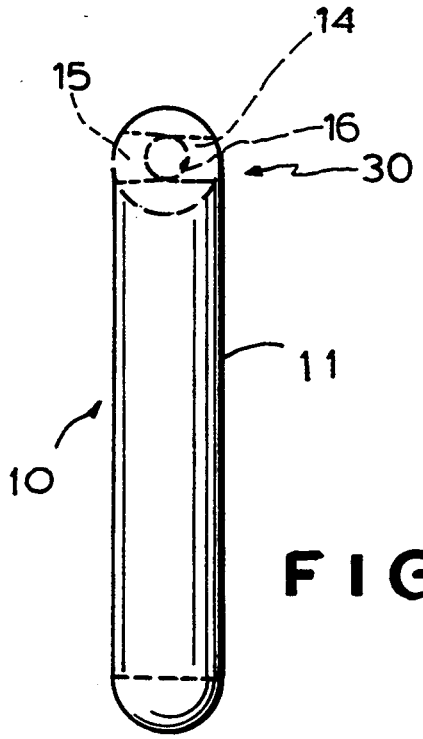
FIG. 3
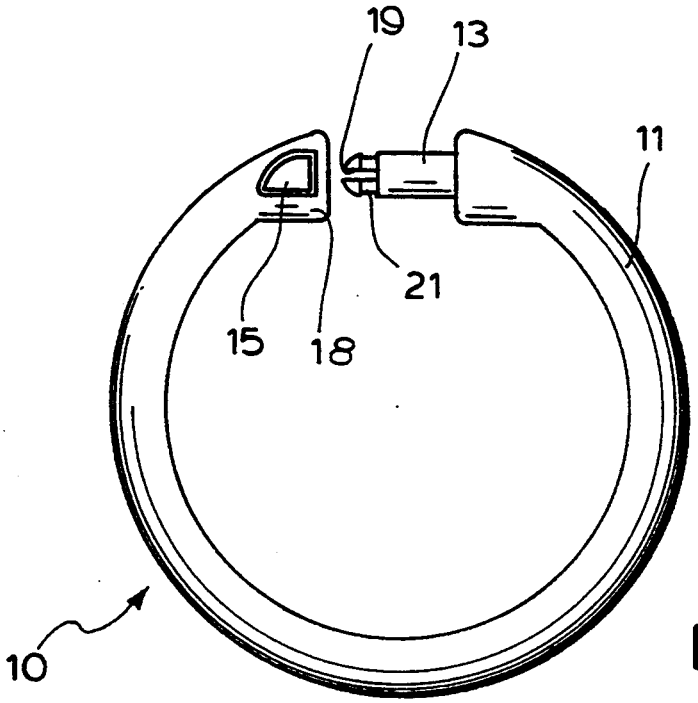
FIG. 5

CLICK-LOCK RING FOR HANGING SHOWER CURTAINS

FIELD OF THE INVENTION

The present invention is directed to a new and improved click-lock ring for use in hanging shower curtains.

BACKGROUND OF THE INVENTION

A large number of designs of plastic rings are known in the prior an for hanging curtains and shower curtains. These are illustrated in the following patents:

Blod, U.S. Pat. Des. No. 178,862 shows an open circular curtain ring with a connecting pin that bridges the edges of the gap.

Imershein, U.S. Pat. Des. No. 228,624 illustrates a design of a shower curtain holder with a snap connector. However, the pin forming the snap connection is not slotted at the end.

Bussell, U.S. Pat. Des. No. 296,299 shows a ring that is substantially circular with a gap bridging pin.

Bussell, U.S. Pat. Des. No. 296,299 shows a ring that is a substantially square curtain holder with a circular hole, and a pin that bridges the gap.

Snyder U.S. Pat. No. 3,115,181 describes a curtain ting construction which is rather complex and difficult to manufacture.

Kimel, U.S. Pat. No. 3,772,734 describes an openable ring for curtains having a body in the form of a loop carrying two jaws at the end of the loop.

Thus, known shower curtain rings may constitute a loop designed in such a manner as to "click lock". Due to the design of these or their complexity they often can only be produced at low speed and in limited quantities.

SUMMARY OF THE INVENTION

The present invention is directed to a new and improved "click lock" shower curtain ring for use in hanging shower curtains. It is designed in the form of a ring or loop wherein one end contains an anchoring recess for receiving a head connected to the end. The recess is formed at the sides during formation by opposed elements, rather than at the circumference by a single element, and this design permits efficient manufacture in a cam-free injection mold. Due to the unique design of the ring and in particular its cam-free moldability in terms of the mold used to manufacture it, it can be produced economically at high speeds and in large quantities.

For a better appreciation of the new ring and its attendant advantages, reference should be made to the following detailed description taken in conjunction with the accompanying drawings.

DESCRIPTION OF THE DRAWINGS

FIG. 3 is an end view of the ring;

FIG. 4 is a cross-sectional view of the ring showing an end view of the recess opening; and FIG. 5 is a front elevational view showing the opposite side of FIG. 1.

DETAILED DESCRIPTION OF THE INVENTION

In accordance with the principles of the present invention, a novel click lock ring used in hanging shower curtains, as a result of its new and improved design, can be produced efficiently and in large quantities in a cam-free mold of an injecting molding machine. In addition, the new shower curtain ring provides very easy and improved click closure by virtue of openings on the sides which intersect and define a central anchoring recess. Furthermore the new ring eliminates the unsightly equatorial hole (i.e. the equatorial portions of the ring are free of openings) which existed heretofore on the equator of rings produced in cammed molds, thereby enhancing the aesthetics of the new ring.

Figure 1:
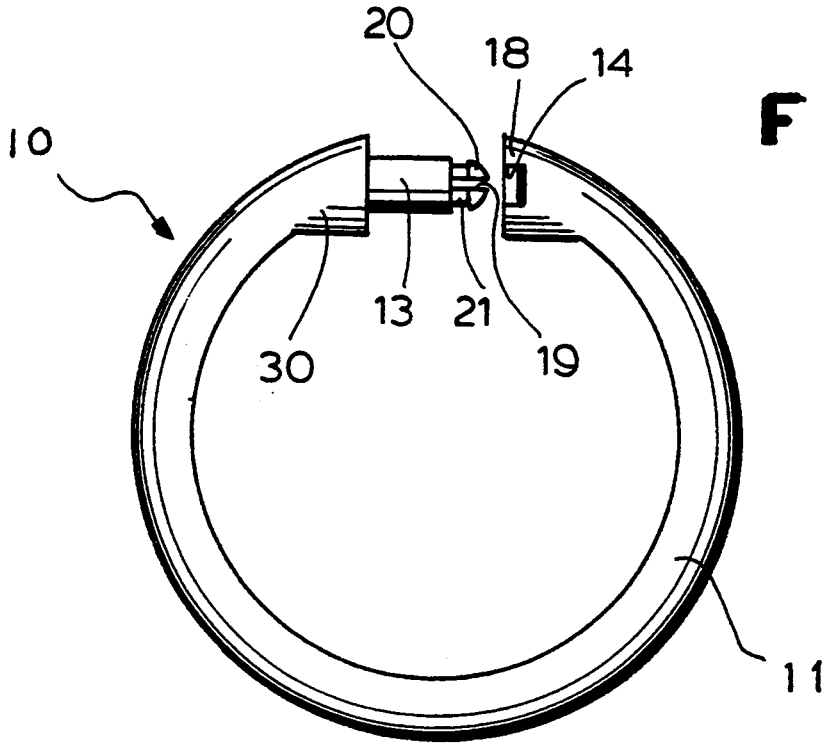
FIG. 1 is a front elevation view of a new and improved "click lock" shower curtain ring according to the present invention.
Figure 2:
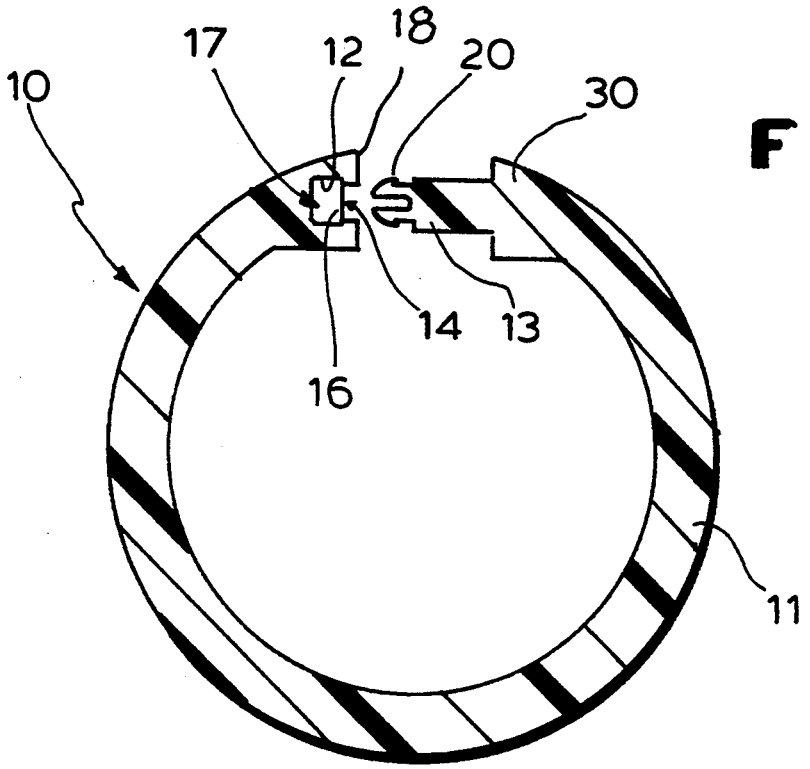
FIG. 2 is a cross sectional view of the shower curtain ring of FIG. 1.

The new ring 10 shown in FIGS. 1 and 2 is made of plastic material and includes an annular ring body 11 with an anchoring recess 12 (FIG. 2) for receiving a locking pin 13. The anchoring recess 12 is formed during molding by two opposed male mold members (in a cam-free mold) which cooperate to form first and second offset lateral openings 14, 15 which combine to establish a stepped chamber having a small diameter throat portion 16 and a larger diameter head-receiving portion 17. A C-shaped annular flange 18 is formed to accommodate a "snap" or "click" closure for the pin 13 as will be understood. Thus the pin 13 will enter the throat 16 of the recess 12 in closing the curtain ring although the recess will be open to the sides of the ring, below the equator, due to the nature of its formation by two lateral molding elements.

The locking pin 13 has the configuration shown in FIGS. 1 and 2 and contains a slot-like opening 19 in a bulbous bayonet head 20. An annular groove 21 separates the head 20 from the pin body 113. The tip of the head is of smaller diameter than the major diameter of the head and is tapered at the end for easier clicking insertion into and removal from the anchoring recess 12. The head 20 is inserted and withdrawn from anchoring recess 12 by flexing the ring body 11 out of its normal circular configuration, the resiliency of the ring 11 maintaining the ring in its initial circular configuration when the ting is no longer flexed.

As shown in FIGS. 2 and 3, the ring 11 is essentially semi-circular in cross section except at the uppermost portions 30 where it is enlarged into circular cross-section. Importantly, the first recess terminates in a semi-circular wall portion **14*a* which cooperates with a semi-circular wall portion 15*a* in the second recess to define the circular throat 16**.

The new and improved open ring of the invention may be produced in large multiples in a cam-free mold in a standard injection molding machine which allows for greater efficiency than heretofore possible in the production of "click-lock" rings.

Although the foregoing description has been given by way of preferred embodiment, it will be understood by those skilled in the art that other forms of the invention falling within the ambit of the following claims is contemplated. Accordingly, reference should be made to the following claims in determining the full scope of the invention.

What is claimed is:

1. A one-piece flexible molded shower curtain hanger having:

(a) a split ring body portion having opposed free ends adapted to be selectively opened and closed by mating male and female portions formed integrally with said free ends;

(b) said male portion comprises a pin element, perpendicular to the radius of the ring at the free ends, having a bulbous head portion of predetermined first outer diameter;

(c) said head portion being slotted to permit said outer diameter to be compressed;

(d) said female portion being in the form of an axially extending recess aligned with said pin including combined offset lateral first and second openings intersecting the sides of said ring as well as the free end facing said pin;

(e) the equatorial portions of said ring are free of openings; said recess having a small diameter throat opening approximately equal in diameter to that of the bulbous head ahead of a larger diameter head-receiving chamber; whereby said bulbous head is adapted to be inserted into and removed from said recess with a click locking action by flexing of said ring.

2. The shower curtain hanger of claim 1 in which (a) said first lateral opening is in the form of a lateral channel terminating in a first semi-circular wall portion the center of which lies above the axis of said pin;

(b) said second lateral opening terminates in a second semi-circular wall portion the center of which lies along the axis of said pin;

(c) said first and second semi-circular wall portions combining to form a female pin-receiving member of circular cross-section;

(d) whereby said ring is manufactured in a cam-free injection mold.

* * * * *